United States Patent [19]

McClure

[11] Patent Number: 4,919,212

[45] Date of Patent: Apr. 24, 1990

[54] TRACTOR MOUNTING FOR A DOZER BLADE

[76] Inventor: Ronald G. McClure, R.D. #2, Box 43A, Columbia Crossroads, Pa. 16914

[21] Appl. No.: 335,647

[22] Filed: Apr. 10, 1989

[51] Int. Cl.[5] ..... E02F 3/76

[52] U.S. Cl. ..... 172/274; 172/817; 172/820

[58] Field of Search ..... 172/817, 272, 273, 274, 172/275, 820

[56] References Cited

U.S. PATENT DOCUMENTS

| | | | |
|---|---|---|---|
| 2,645,866 | 7/1953 | McGee | 172/817 |
| 3,749,180 | 7/1973 | Coontz | 172/817 |
| 3,773,116 | 11/1973 | Coontz | 172/817 |
| 4,554,978 | 11/1985 | Schneider | 172/817 |

*Primary Examiner*—Richard J. Johnson

*Attorney, Agent, or Firm*—Salzman & Levy

[57] ABSTRACT

The invention features a mounting frame and lift assembly for a dozer blade of a tractor. The frame and assembly is easy to install and provides quick connection to the dozer blade. The lift assembly is provided with a pivot placed forward of the front wheel of the tractor to enhance the lifting angle for the dozer blade.

9 Claims, 5 Drawing Sheets

FIG 1
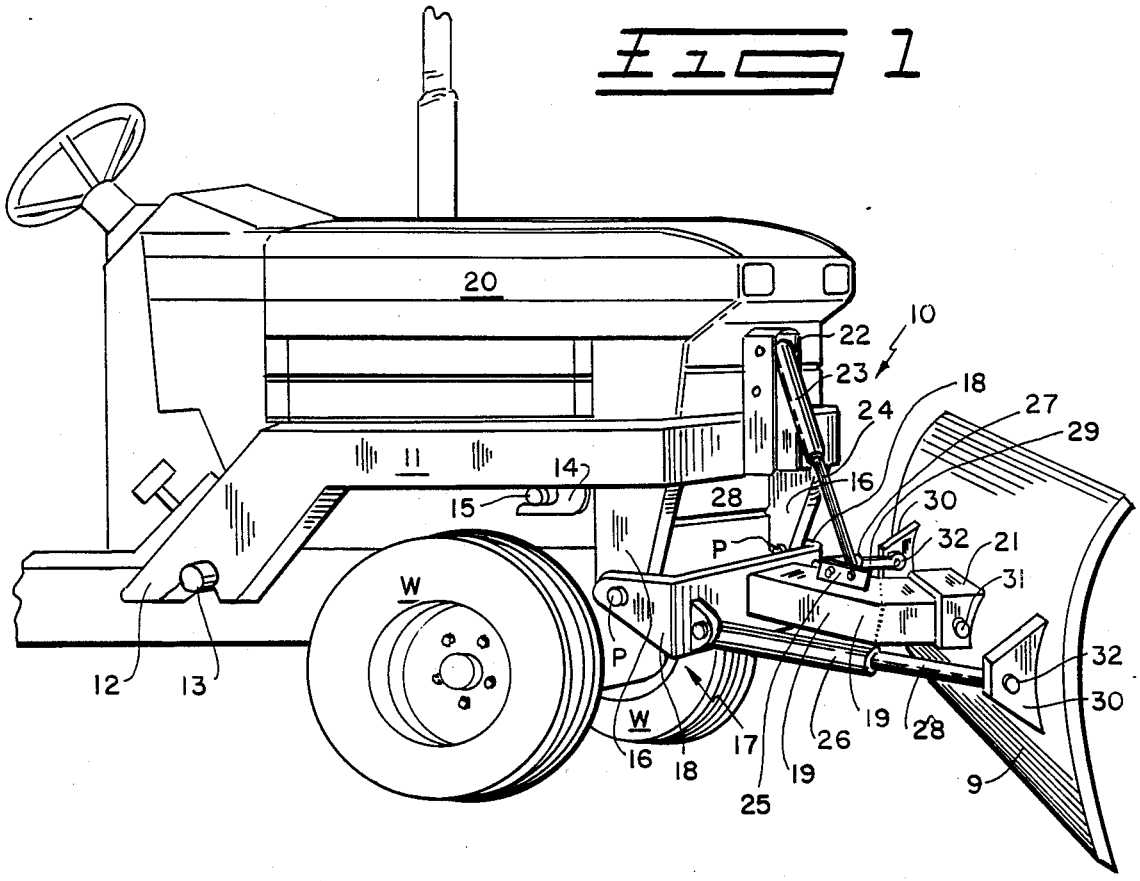
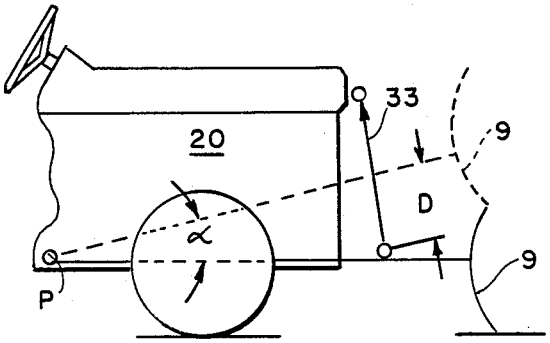
FIG 1a
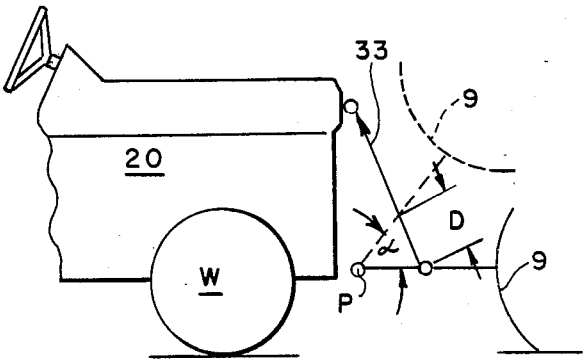
FIG 1b

TRACTOR MOUNTING FOR A DOZER BLADE

FIELD OF THE INVENTION

The invention relates to dozer blade attachments for tractors, and more particularly to a dozer blade attachment that is easily and quickly affixed to the tractor body and which provides a greater amount of lift angle to the dozer blade.

BACKGROUND OF THE INVENTION

Dozer blade attachments for tractors have been generally difficult to install, and often do not provide enough lift to the dozer blade for clearance on ramps and inclines.

It has been discovered that these attachments are more easily secured by placing the pivot segments in front of the tractor where they provide a greater access and handling facility.

In placing the pivot in front of the tractor, the invention further provides a greater lift angle for the dozer blade, wherein the tractor can easily negotiate ramps and inclines with the blade affixed thereto.

Another difficulty with prior art attachments is that they are often secured to the tractor under-carriage or chassis, thus restricting and limiting the clearance over the navigable terrain.

The invention provides still another benefit in that the dozer blade attachment does not extend below the chassis or under-carriage of the tractor.

DISCUSSION OF RELATED ART

In E. C. Alexander, U.S. Pat. No. 2,559,816; issued: July 10. 1951, a bulldozer attachment for tractors is shown wherein the bulldozer blade attachment is pivotably attached behind the front wheel of the tractor. The long pivot arm extension, while providing increased mechanical advantage, has the drawback decreasing the available angle of lift.

A dozer blade attachment illustrated in W. A. Bartel; U.S. Pat. No. 4,304,305, issued: Dec. 8, 1981, utilizes a pivotable frame that attaches to the underchassis of the tractor. While the design of this attachment may provide a suitable degree of lift for the dozer blade, the attachment point being below the chassis makes the adaption of the device to the tractor both inconvenient and time consuming. In addition, the attachment point being below the under-carriage limits the clearance that the tractor will have over navigable terrain.

In L. T. McGee; U.S. Pat. No. 2,645,866; issued: July 21, 1953, a dozer attachment is shown wherein two pivotable linkages are employed to lift and manipulate the dozer blade. While the illustrated attachment is very versatile, it is also extremely complicated. This attachment is also permanently mounted, and does not provide for quick disassembly.

SUMMARY OF THE INVENTION

The invention features a tractor mounting frame and lifting assembly for quickly attaching and detaching a dozer blade to a tractor. The tractor mounting frame comprises a cradle having a number of stanchions for attachment to the body of the tractor. A lifting assembly is pivotably supported on a front end of the cradle and supports the dozer blade. the pivotable axis of the lifting assembly is disposed in front of the front wheel axle of the tractor, thus providing a high angle of lift.

The lifting assembly is pivotably raised by a hydraulically actuated cylinder that is supported upon the front end of the cradle and pivotably secured to the lifting assembly. When the lifting assembly is raised, the dozer blade is likewise raised.

The tractor mounting frame is easily installed because it has been designed to fit upon supports that have commonality and universality with a wide range of tractors using quick attachable loaders.

The dozer blade is easily attached and detached from the lifting assembly by means of a few securing pins and hydraulic connections.

It is an object of the invention to provide an improved dozer blade mounting frame and assembly.

It is another object of this invention to provide a tractor mounting frame for a dozer blade that is easily installed and that quickly attaches and detaches to a dozer blade.

It is a further object of the invention to provide a dozer blade lifting assembly that has a high angle of lift.

It is yet another object of this invention to provide a dozer blade mounting that does not limit the clearance of the under-carriage of the tractor.

It is a further object of the invention to provide a dozer blade mounting frame and assembly to the front of which can be mounted a sweeping broom.

BRIEF DESCRIPTION OF THE DRAWINGS

These and other objects of the invention will become more apparent and will be better understood with reference to the subsequent detailed description considered in conjunction with the accompanying drawings, in which:

FIG. 1 is a perspective, in situ view of the dozer blade mounting assembly and frame of this invention;

FIG. 1*a* is a schematic view of a prior art tractor assembly having a limited lift angle for the dozer blade;

FIG. 1*b* is a schematic view of the inventive tractor assembly of FIG. 1, wherein a greater angle of lift is achieved by placement of the pivot axis in front of the tractor front wheel axis;

DETAILED DESCRIPTION OF THE PREFERRED EMBODIMENT

Figure 2:
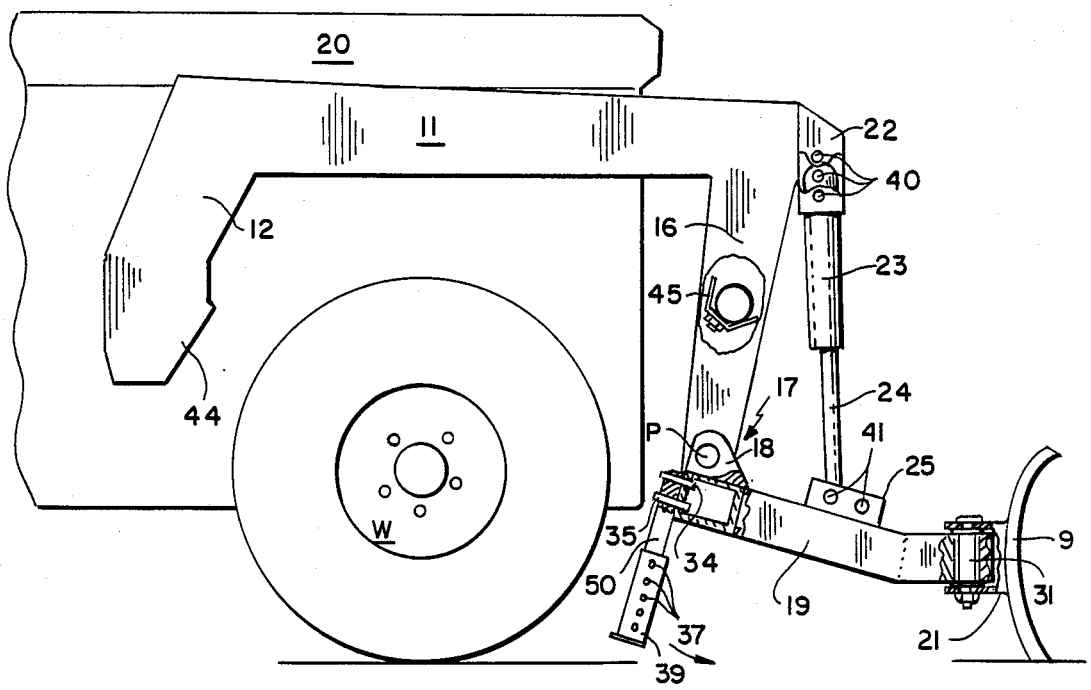
FIG. 2 is a side view of the tractor mounting frame and lifting assembly of the invention illustrated in FIG. 1.

Generally speaking, the invention pertains to an easily installed dozer blade mounting frame and lift assembly wherein the dozer blade mounting frame is quickly attached and detached from a tractor in a matter of a few minutes. The assembly is characterized by its ability to provide a high angle of lift without limiting the clearance of the tractor under-carriage.

For purposes of brevity and clarity, like elements will bear the same designation throughout the FIGURES.

Now referring to FIG. 1, the tractor mounting frame and lifting assembly 10 of this invention is shown mounted to a tractor 20.

The mounting frame 11 comprises a U-shaped cradle having a number of stanchions or mounting arms. The rear stanchions 12 are supported upon trunnions 13 that project from the body of the tractor 20.

The forward stanchions 14 are hook-shaped, and hook about trunnions 15.

A pair of forwardly placed mounting arms 16 is used to support lifting assembly 17, that pivots from the ends of mounting arms 16 at points "P". The pivot axis defined by points P is disposed in front of the front tractor wheels "W".

It is this forward pivot point P that provides a high lift angle $\alpha$ for the dozer blade 9, which will be explained in more detail hereinafter with reference to FIGS. 1*a* and 1*b*. Although dozer blade 9 is depicted in the Figures, other embodiments may incorporate various attachments, such as brooms for sweeping.

The lifting assembly 17 comprises a U-shaped carriage defined by its two side pivot arms 18.

A dozer blade mounting arm 19 extends from a mid-section of lifting assembly 17. The mounting arm 19 is angled horizontally in a mid-portion thereof in order to slide into bracket 21 of the dozer blade 9.

A hydraulically actuated cylinder 23 is pivotably mounted in top bracket 22 of cradle 11. The piston rod 24 which extends from cylinder 23 pivotably attaches to bracket 25 on arm 19.

Two side mounted hydraulic cylinders 26 and 27, respectively mount to lift assembly 17 on either side of extension arm 19. The piston rods 28 and 29 that respectively extend from cylinders 26 and 27 each attach to dozer blade side flanges 30. These side mounted piston rods 28 and 29 adjust the angle of sweep for dozer blade 9.

In order to lift the dozer blade 9, hydraulic cylinder 23 is actuated, and its piston rod 24 is retracted, thus pulling upwardly extension arm 19 and blade 9 attached thereto.

The dozer blade 9 is easily attached to lift assembly 17 by a pin 31 that attaches bracket 21 to extension arm 19, and pins 32 that attach piston rods 28 and 29 to their respective flanges 30.

Likewise, cylinders 23, 26 and 27 are easily attached by pins to their mountings.

Figure 4:
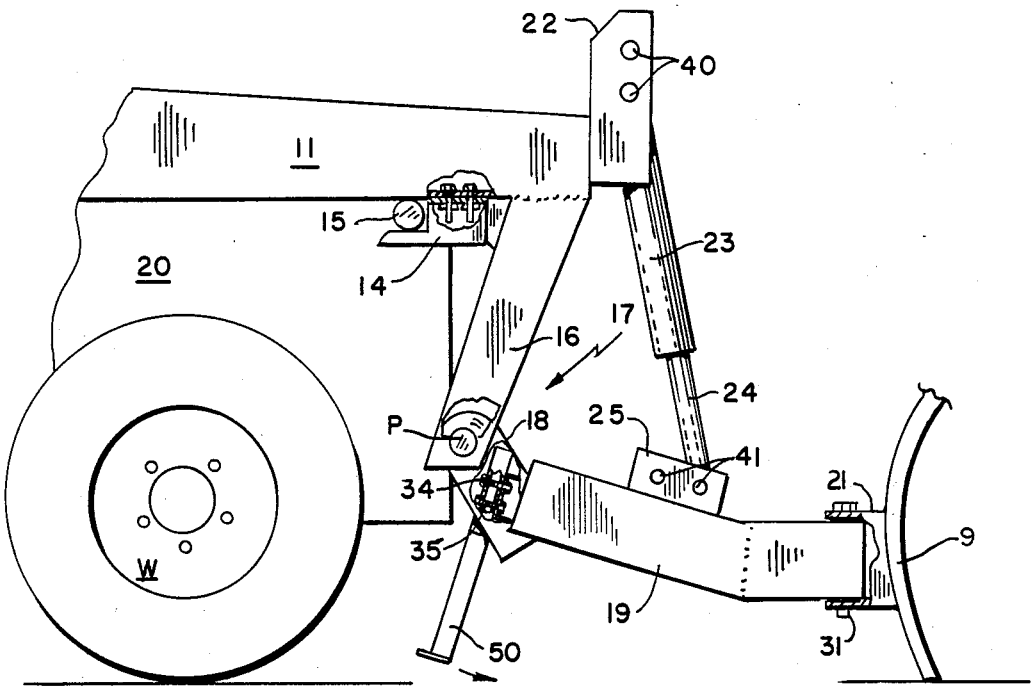
FIG. 4 is a side view of the lifting assembly that attaches to the mounting frame shown in FIG. 3.

Adjustments in length and angle are accommodated by various mounting holes in the brackets and flanges as will be illustrated in FIGS. 2 and 4.

Hydraulic lines feeding cylinders 23, 26 and 27 use quick connect and disconnect fittings.

Referring to FIGS. 1*a* and 1*b*, the invention will be illustrated with respect to its higher lift angle $\alpha$ capability.

FIG. 1*a* shows in schematic view a prior art tractor 20, whose lift assembly pivot point P is positioned behind front wheel W.

For a given pull (arrow 33) of cylinder 23 capable of retracing piston rod 24 a distance "D", it will be noticed that $\alpha$, the lift angle, is acutely small.

By contrast, when the pivot point P of the lifting assembly is placed forward of the front wheel W, the lift angle $\alpha$ for the same piston movement D is almost twice that of the prior art.

Thus, by placing the pivot point P in front of the front tractor wheel W, the invention provides enough dozer blade lift, such that the blade 9 will allow the tractor 20 to negotiate loading ramps and steep inclines.

Referring to FIG. 2 the cradle 11 and lifting assembly 17 is shown in greater detail.

It will be noted that brackets 22 and 25 have a series of adjustment holes 40 and 41, respectively in order to easily mount and attach cylinder 23 and piston rod 24 between the cradle 11 and extension arm 19.

A jack stand 50 is shown in this FIG. attached to lift assembly 17 by a locking and swing pin 34 and 35, respectively.

The jack stand 50 is adjustable in height by virtue of a number of installing holes 37, which can be pinned anywhere along the length of end piece 39.

The jack stand 50 has as its purpose to provide support for the lift assembly 17 when the hydraulic power is terminated or when the lift assembly 17 is separated from cradle 11.

The cradle 11, which is designed to fit a Kubota tracotr Model No. L-2850, has two rear stanchions 12 that nest in brackets 44. Its two forward legs are supported in a ball mounting bracket 45.

From the foregoing description, it can be seen that the dozer blade of the invention has a stand at the blade pivot point that descends during assembly detachment from the tractor. When rear attaching points are loosened, the hydraulic control valve can be activated in a lift position to set the stand onto the ground, lifting the rear of the dozer frame off of the rear attaching points. Sufficient clearance is provided the front tires so that when the tractor is backed out, the tires are unobstructed.

Figure 3:
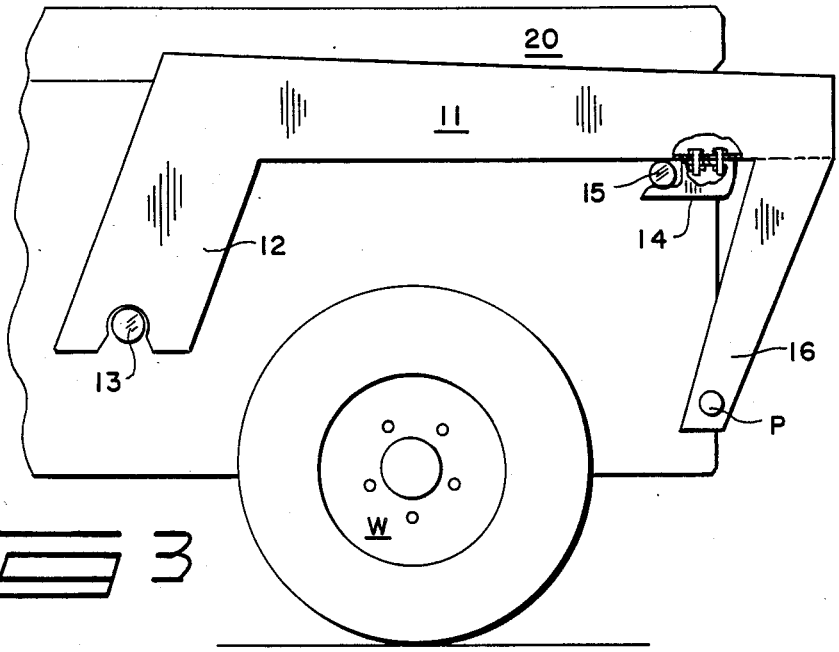
FIG. 3 is a side view of an alternate embodiment of the mounting frame depicted in FIG. 2.

FIG. 3 shows an alternate embodiment of cradle 11 designed to accommodate a Ford Model No. 1120-1220 tractor. It has rear stanchions 12 supported by trunnions 13; and forward hook-like stanchions that hook about trunnions 15, as illustrated in FIG. 1.

Referring to FIG. 4, the cradle 11 embodiment of FIG. 3 is shown with a slightly different lift assembly 17 and front cylinder mounting bracket 22.

Figure 5:
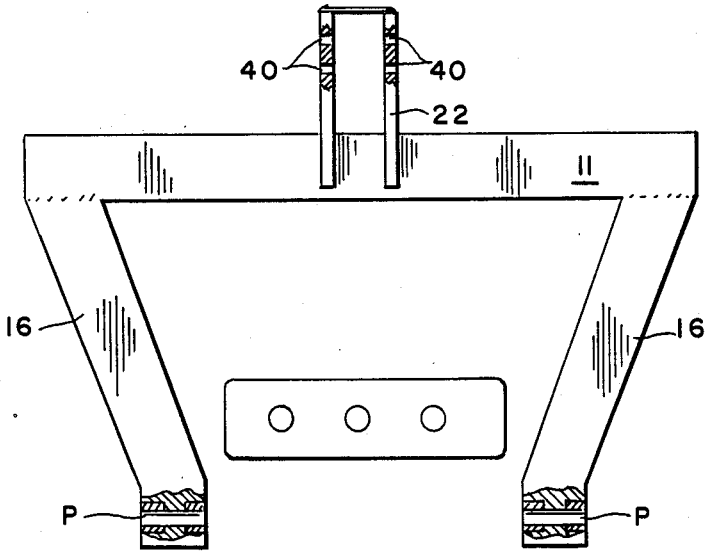
FIG. 5 is a front view of the mounting frame illustrated in FIG. 4.

FIG. 5 depicts a front view of the cradle 11 of FIG. 4.

Figure 6:
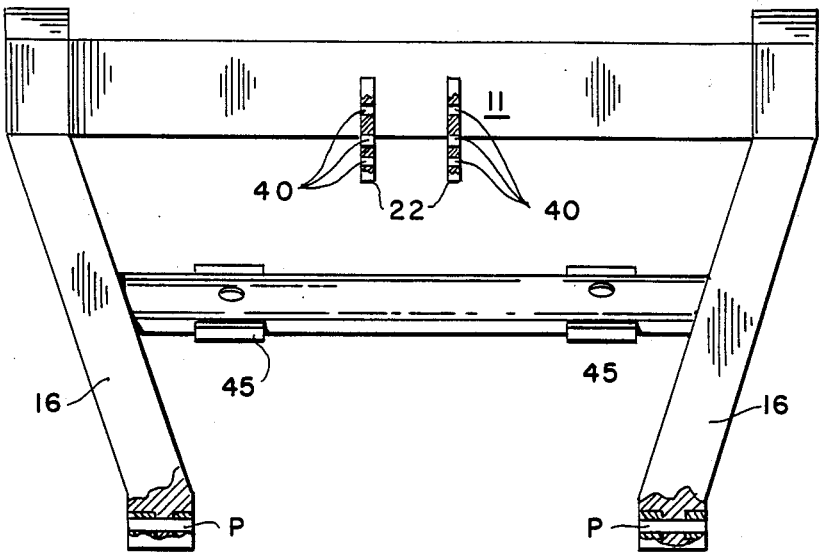
FIG. 6 is a front view of the mounting frame depicted in FIG. 2.

FIG. 6 illustrates a front view of the cradle 11 of the embodiment in FIG. 2.

Figure 7:
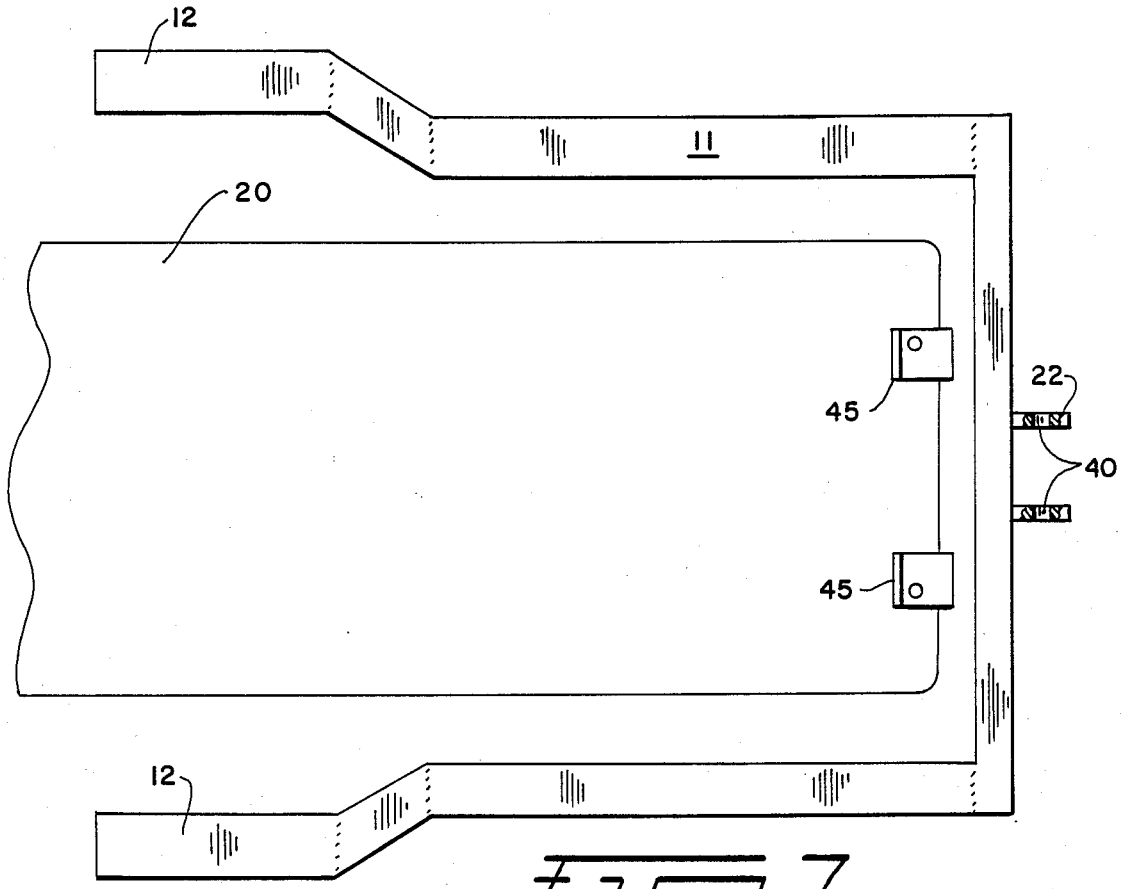
FIG. 7 is a top view of the mounting frame shown in FIG. 2.

Referring to FIG. 7, a top view of the cradle 11 of FIGS. 2 and 5 is shown.

Figure 8:
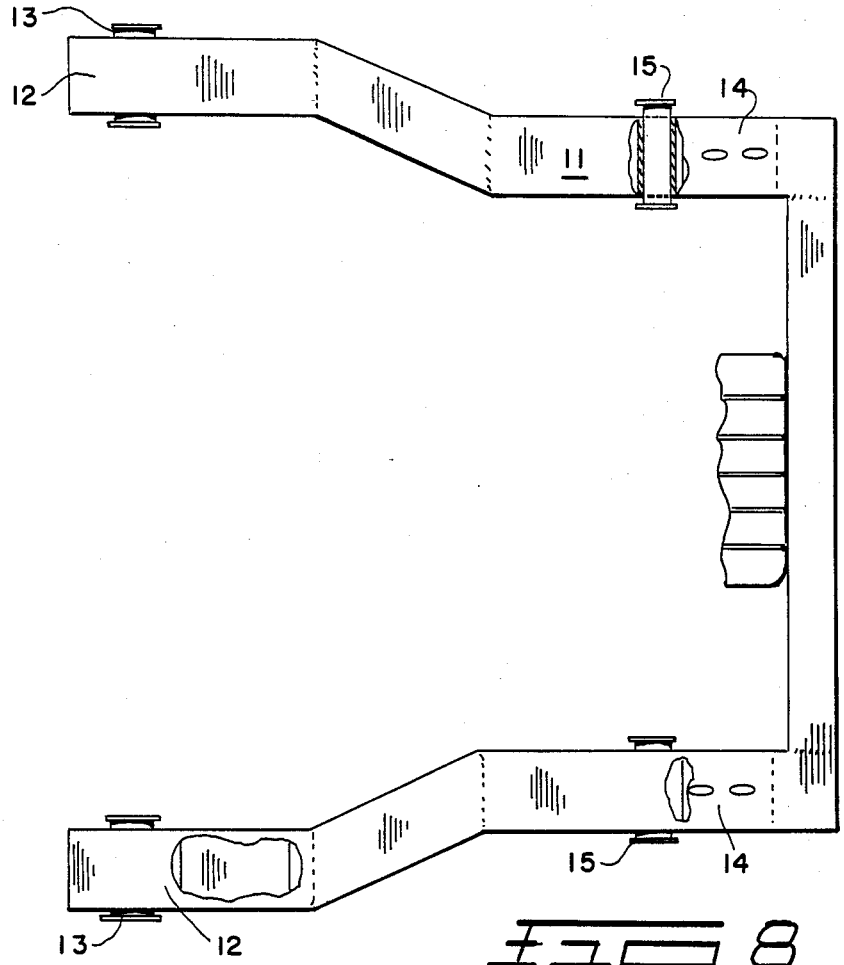
FIG. 8 is a top view of the mounting frame illustrated in FIG. 4.

FIG. 8 is a top view of cradle 11 for the embodiment shown in FIGS. 3 and 4.

Figure 9:
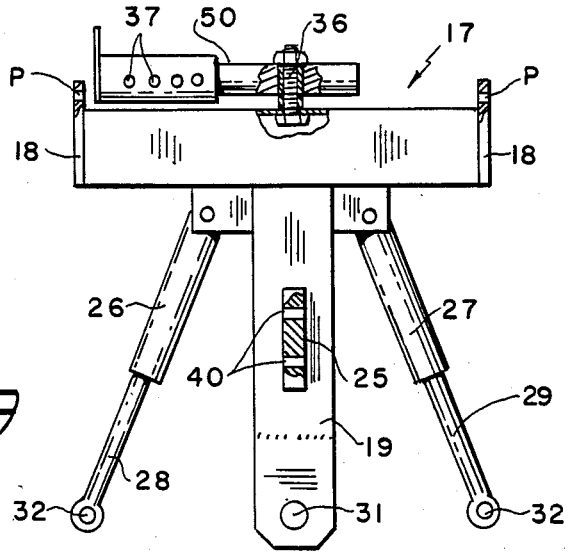
FIG. 9 is a top view of the lift assembly shown in FIG. 2.

FIG. 9 is a top view of the lift assembly 17 shown in FIG. 2. The lift assembly for FIG. 4 is essentially identical.

Since other modifications and changes varied to fit particular equipment (tractors), operating requirements and environments will be apparent to those skilled in the art, the invention is not considered limited to the example chosen for purposes of disclosure, the covers all changes and modifications which do not constitute departures from the true spirit and scope of this invention.

Having thus described this invention, what is desired to be protected by Letters Patent is presented by the subsequently appended claims; what is claimed is:

1. A quickly attachable and detachable tractor mounting assembly for a dozer blade that has a pivotable lifting axis above and in front of a front wheel axis to provide undercarriage clearance and improved lift for said dozer blade, comprising:

a generally U-shaped cradle releasably mounted about front and sides of a body portion of said tractor, and substantially surrounding said body portion;

means defining a pivot supported by said cradle and disposed in front of and above said front wheel axis of a tractor to provide undercarriage clearance and improved dozer blade lift angle;

a dozer blade attachment comprising a generally U-shaped assembly pivotably supported by said U-shaped cradle about said means defining said pivot, and including a forwardly extending dozer support arm angled in a mid-portion thereof; and lifting means supported by said cradle and pivotably secured to said dozer blade attachment for lifting said dozer blade attachment and a dozer blade secured thereto.

2. The tractor mounting of claim 1, wherein said lifting means comprises a hydraulically actuated cylinder and movable piston rod.

3. The tractor mounting of claim 2, wherein said hydraulically actuated cylinder is substantially vertically disposed with respect to said dozer blade attachment.

4. The tractor mounting of claim 1 wherein said dozer blade attachment comprises an adjustable jack stand.

5. The tractor mounting of claim 1, further comprising a hydraulically actuated cylinder disposed on either side of said dozer support arm for positioning and adjusting a sweep angle of a dozer blade.

6. A method in accordance with claim 12 of attaching and lifting a dozer blade with respect to a tractor, comprising the steps of:

(a) releasably mounting a cradle upon side mountings of a tractor body;

(b) securing a dozer blade attachment to said cradle about a pivot disposed above and in front of a front wheel axis of said tractor, whereby clearance is provided in an undercarriage of said tractor;

(c) supporting a lifting means upon a front end of said cradle of said tractor and pivotably attaching said lifting means to said blade attachment;

(d) attaching a dozer blade to said lifting means; and (e) actuating said lifting means to lift said attachment and said dozer blade.

7. A tractor implement mounting assembly for mounting an implement on the front of a tractor wherein the tractor has a front wheel axis and trunnions disposed on each side thereof, said mounting assembly including a rigid generally U-shaped cradle having a pair of longitudinal side members and a transverse front member, each side member including a pair of stanchions providing means for releasably engaging said trunnions and detachably securing the cradle on the tractor, forward ends of the side members each including a rigid downwardly extending mounting arm having pivot means thereon, in a position generally located forwardly of the tractor and above said front wheel axis, a lifting assembly comprising a generally U-shaped carriage member having rearwardly extending side arms pivotally connected to a pivot means, a forwardly extending implement support secured to said carriage member, and a hydraulic cylinder connected between said transverse front member and said implement support for lifting said implement secured to said implement support.

8. The tractor mounting frame and lifting assembly of claim 7, wherein said cradle has a U-shaped frame which girdles about the body of said tractor.

9. The tractor mounting frame and lifting assembly of claim 7, wherein said lifting assembly supports an adjustable jack stand.

* * * * *